United States Patent [19]

Horton

[11] 4,126,903

[45] Nov. 28, 1978

[54] T T IMPROVEMENTS RELATING TO CLOTHES

[76] Inventor: Douglas P. M. Horton, 5 Borthwick Ct., Beaumont, Adelaide, South Australia, Australia, 5066

[21] Appl. No.: 731,008

[22] Filed: Oct. 8, 1976

[30] Foreign Application Priority Data

Oct. 10, 1975 [AU] Australia ..... PC3526

[51] Int. Cl.[2] ..... A41B 9/04

[52] U.S. Cl. ..... 2/409; 2/DIG. 1

[58] Field of Search ..... 2/409, 406, 407, DIG. 1, 2/239, 227; 66/177, 186, 187

[56] References Cited

U.S. PATENT DOCUMENTS

| | | | |
|---|---|---|---|
| 179,661 | 7/1876 | Lee | 2/DIG. 1 |
| 1,999,929 | 4/1935 | Hearn | 2/239 |
| 2,391,535 | 12/1945 | Zelano | 2/DIG. 1 |
| 3,301,013 | 1/1967 | Moyer | 66/187 X |
| 3,417,408 | 12/1968 | Caggiano | 2/239 |
| 3,566,624 | 3/1971 | Burleson | 66/177 |
| 3,815,156 | 6/1974 | Gaither | 2/409 |
| 4,009,495 | 3/1977 | Faust | 2/406 |

FOREIGN PATENT DOCUMENTS

| | | | |
|---|---|---|---|
| 1,190,399 | 3/1959 | France | 2/409 |
| 732,192 | 6/1955 | United Kingdom | 2/409 |

*Primary Examiner*—H. Hampton Hunter
*Attorney, Agent, or Firm*—Kinzer, Plyer, Dorn & McEachran

[57] ABSTRACT

A garment of a type generally known as pantyhose having a plurality of ventilation panels both around a pants portion and preferably along a leg and toe portion to promote healthy breathing of sensitive portions of the skin of the body.

1 Claim, 3 Drawing Figures

T T IMPROVEMENTS RELATING TO CLOTHES

This invention relates to a garment which is made as a one-piece item in which artificial fibre made from a material such as that filed under the Trade Mark "Nylon" is knitted and such garments are normally known as "pantyhose".

It has been discovered that while such garments are immensely popular particularly among adult females, there are considerable difficulties associated with the wearing of such articles.

It has been found that persons wearing such garments as are presently manufactured, are subject to problems including odour, skin erruptions, irritation and inflammation of genitals, aching legs, leg pains, swelling legs and ankles.

It is understandable of course that most adult females are most reluctant to discuss the problem in that it is of an essentially personal nature and even medical practitioners who are aware of the problem are not inclined to discuss or inform persons in a wider sphere of the immensity of the problem.

There is the problem in relation to any proposed answer to such difficulties that any such answer must be both acceptable by a fashion conscious female population and must be commercial in the sense that it must not unduly raise the price of a product that can be offered for sale to adult females.

In experiments that I have conducted, I have found that while the genitals and general crutch area is most sensitive to the problem, the skin in general terms surrounding the buttocks and also some parts of the leg and also some parts of the foot particularly underneath the toes can also be made subject to such problems.

From my researches, it appears that the tightly woven knit material made from the fine nylon thread appears to restrict normal breathing and therefore a ready cooling effect as normally experienced on the surface of the skin and it may be that the characteristic of the nylon material experiencing a static build-up in electricity charge also alters the physiological condition of the skin in immediate vicinity of the fabric.

Due to the lack of ventilation directly into the skin, there is little or no evaporation of the perspirant factors, which places the physiology of the body in a state which exceeds the limitations of matter. For example, a painted body will ensure demise of the human body in 20 minutes, and ventilation is thus essential to the well-being of the human body. Hence even partial cooling of the body to prevent evaporation of certain areas of the body raises the toxicity level build up in those areas.

Particular problems have been experienced in the genital area where the exudation of moisture causes a high humidity with warm environmental conditions which leads to bacterial effect and this also appears to have an effect of reducing resistance to fungal diseases and such effects are most distressing to the adult females.

The advantages of these garments however being low in cost and most convenient and at the same time offering very good support both around the buttock area and for maintaining tension of the stocking portion are such that most adult females continue to purchase such articles and to wear these consistently.

Perhaps the problem to which this invention can be said to be directed is to provide an answer to the above problem so far as causing susceptibility to infection and feeling of uncomfortableness while at the same time maintaining the advantages of cheapness, tightness of form and perhaps most importantly, a maintenance of a good appearance from a fashion point of view.

In one form of this invention therefore this can be said to reside in a garment comprised of fine threads of artificial fibre inter-woven in knitted manner to form a garment of the type generally known as a "pantyhose" including a pants portion, legs and feet portion, characterised in that the portions of the garment adapted to be located across the genitals and crotch area of the person wearing the garment is constituted by a pattern in which the threads are held substantially separate one from the other so as to leave open areas between adjacent threads of substantial area as compared to the area covered by the threads so as to provide substantial access for ventilation therethrough.

In a further form of the invention, proposed an arrangement such as above in which a pants portion of the garment includes a knitted pattern within the pants portion at least of the garment whereby in distributed manner throughout the material forming the pants portion there are spaces formed by separating the threads one from the other to the extent as to leave open portions whereby to allow effective ventilation therethrough.

Perhaps according to a further form of the invention, there is proposed a plurality of panels each generally of constant width and located parallel one to the other around the circumference of the pants portion of the stated garment one such panel being centrally located so as to pass around an area that would normally cover a genital and central buttock area of the person wearing the garment, such panel in each case being made from threads in which the threads are held in separate relation one to the other whereby to leave substantial gaps therebetween to provide for substantial ventilation therethrough, and between such states panels, the garment material is constituted by fabric of conventional type this for reference purposes being termed "sheer knit".

I have found that by providing a garment in which there are a substantial number of wider apertures and where these are distributed over a reasonable area of the body covered by the material then there appears to be a capacity by the body to obtain adequate cooling from such areas. Clearly, the capacity for each person to use such cooling as is available, will vary from person to person and therefore, it does not appear that there are critical limits to the percentage of open area as compared to the sheer woven portions although the limit to the degree of open woven portion appears to be a question of fashion acceptance.

I have further found that there is substantial advantage in providing a similar vertical panel along the leg portion of the garment and I have further found that there is particular advantage in providing a section of open weave as described about the portion covering the toes of the person wearing the garment.

In relation to the pants portion of the garment, it has been found that a knit pattern known as "fish net" in which the threads are drawn so as to leave a diamond shape aperture between the threads has been found to be of substantial advantage in that this provides not only adequate ventilation but this also provides with tension of shape and therefore good holding of buttocks and of course the leg portion of the garment.

Furthermore, the appearance of the knit known as fish net can be considered to be a satisfactory appearance particularly when in the form of a number of vertical bands separated by sheer portions around the pants portion or otherwise as set out and it is felt that this is a preferred embodiment.

The invention shall be better understood with reference to the accompanying drawings in which.

Figure 1:
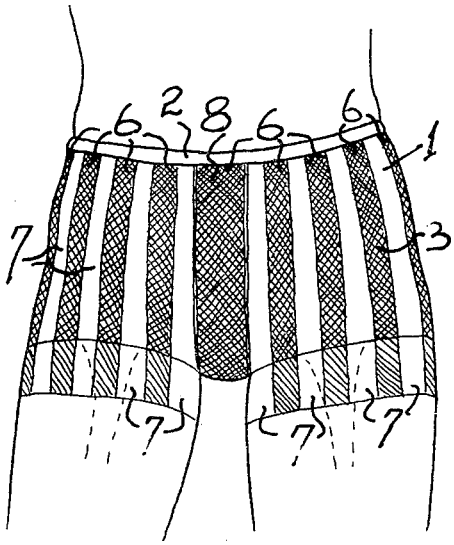
FIG. 1 is a view of the pants portion of a pantyhose type garment according to the first embodiment this showing however the form in somewhat schematic detail.

The garment 1 is composed of a cloth which is generally a knitted weave which is made from very thin and almost transparent fibres of a material which is commonly sold under the Trade Mark "Nylon" and the garment according to this embodiment includes another band 2 a pants portion 3 a leg portion 4 and a foot portion 5.

The pants portion has located therearound a series of vertical panels 6 which are generally of constant width and between each of these panels 6 are portions of sheer knitted weave 7.

One of the panels 6 as being a central panel shown particularly as 8 is located so that this will encircle a genital and crutch area of a person wearing the garment as is shown in the drawing.

Each of the panels 6 is formed by having the threads separately held away one from the other so that as will be seen from the drawing, there is a substantial distance from one thread to the other there being left a number of triangular and square or rectangular shapes through which skin beneath the garment can freely breathe.

In the preferred embodiment the width of each of the ventilation panels as these might be termed, is approximately half an inch and the sheer portions are equally approximately one half inch.

Figure 2:
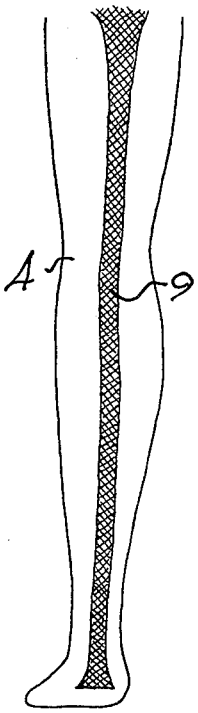
FIG. 2 is a view of one of the leg portions of the preferred embodiment showing a band of open knit along a rearward portion of the leg portion of the garment.

Such ventilation panels 6 extends only down so far as the pants portion of a garment might be said to extend and preferably extends down the leg area to a small extent, in the area where a conventional stocking ends, the panels are terminated by portions of conventional sheer knitted weave except that in the preferred embodiment there is one ventilation panel which continues down the rear side of each of the leg portions this being shown in FIG. 2 as 9.

Figure 3:
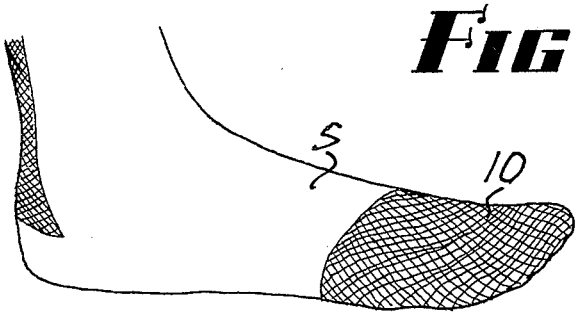
FIG. 3 shows in side elevation a foot portion as it would be located on a foot this particularly having an open weave section around the portion of the garment which would enclose the toes of the wearer.

In FIG. 3, there is shown a ventilation section 10 this being again of similar fish net so that the portions of the knitted weave are kept substantially separate one from the other so as to allow adequate breathing of the pores of the skin therethrough and such section 10 in this case encircles the end of the foot portion 5 as is shown.

This then describes the preferred embodiment.

It is considered that a number of differing types of weaves or knitted weaves can be used to provide the open panel sections or ventilation panel and it is also considered that while it is found to be particularly desirable to have the vertical panels in approximately uniform spacing around the pants portion at least, the panels could in fact be horizontally inclined or they could be constituted by panels of perhaps rectangular or even circular shape distributed around the pants portion.

There are advantages both from the point of view of strength and appearance from the vertical panels and this is to be the preferred embodiment for this reason.

It has been indicated that the garment to which this invention is directed is known as a pantyhose and this is commonly at this time made from a material which is sold under the Trade Mark "Nylon". It is not known of course whether threads of like nature that is artificial plastic fibres of differing type may not be developed in subsequent years and it is not intended that the invention should necessarily be limited to only threads of the nature described but should apply at least perhaps in a wider concept to artificial plastic fibres where these are normally used in a close knitted weave.

I claim:

1. A garment of a type comprised of fine threads of artificial fiber inter-woven in knitted manner to form a garment of the type generally known as a "pantyhose" and including a pants portion, legs and feet portion, characterized in that at least the pants portion of the garment is constituted by having a vertical pattern of spaced panels in which the threads are held substantially separate one from the other in a fish-net weave so as to leave open areas between adjacent threads of substantial area as compared to the area covered by the threads so as to provide substantial access for ventilation therethrough, and the areas between said panels being sheer knit, further characterized in that there is another of the panels vertically aligned along each of the back-of-leg portions of the garment so as to extend the length of the leg portion, further characterized in that a foot portion of the garment has, in relation to a portion of the garment which would normally encompass toes of an individual wearing the garment, an open weave character whereby to provide substantial ventilation.

* * * * *